US009441306B2

(12) United States Patent
Pfirrmann et al.

(10) Patent No.: US 9,441,306 B2
(45) Date of Patent: Sep. 13, 2016

(54) METHOD FOR CATHODIC CORROSION PROTECTION OF CHROMIUM SURFACES

(71) Applicant: Atotech Deutschland GmbH, Berlin (DE)

(72) Inventors: Christina Pfirrmann, Berlin (DE); Philip Hartmann, Berlin (DE); Philipp Wachter, Berlin (DE); Stefan Kretschmer, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/904,461

(22) PCT Filed: Jun. 17, 2014

(86) PCT No.: PCT/EP2014/062660

§ 371 (c)(1),
(2) Date: Jan. 12, 2016

(87) PCT Pub. No.: WO2015/007448

PCT Pub. Date: Jan. 22, 2015

(65) Prior Publication Data

US 2016/0168725 A1 Jun. 16, 2016

(30) Foreign Application Priority Data

Jul. 19, 2013 (EP) ..... 13177307

(51) Int. Cl.

| | |
|---|---|
| ***C25D 11/36*** | (2006.01) |
| ***C23F 13/02*** | (2006.01) |
| ***C25D 5/48*** | (2006.01) |
| ***C25D 9/08*** | (2006.01) |
| ***C25D 9/04*** | (2006.01) |
| *C25D 5/14* | (2006.01) |

(52) U.S. Cl.

CPC ..... *C23F 13/02* (2013.01); *C25D 5/48* (2013.01); *C25D 9/04* (2013.01); *C25D 9/08* (2013.01); *C25D 11/36* (2013.01); *C25D 5/14* (2013.01)

(58) Field of Classification Search

CPC ..... C25D 9/08; C25D 9/10; C25D 11/36; C25D 5/48

USPC ..... 205/318

See application file for complete search history.

(56) References Cited

U.S. PATENT DOCUMENTS

| | | | | |
|---|---|---|---|---|
| 4,501,667 | A * | 2/1985 | Cook | C02F 5/14 106/14.12 |
| 4,617,095 | A * | 10/1986 | Tomaszewski | C25D 11/38 205/179 |
| 4,724,244 | A | 2/1988 | Kempter et al. | |
| 5,401,381 | A | 3/1995 | Seidel et al. | |
| 2011/0272284 | A1 | 11/2011 | Elbick et al. | |

FOREIGN PATENT DOCUMENTS

| | | |
|---|---|---|
| EP | 2186928 | 5/2010 |
| WO | 9217628 | 10/1992 |

OTHER PUBLICATIONS

PCT/EP2014/062660; PCT International Search Report and Written Opinion of the International Searching Authority dated Jul. 24, 2014.

PCT/EP2014/062660; PCT International Preliminary Report on Patentability mailed Jul. 17, 2015.

* cited by examiner

*Primary Examiner* — Nicholas A Smith
*Assistant Examiner* — Brian W Cohen
(74) *Attorney, Agent, or Firm* — Renner, Otto, Boisselle & Sklar, LLP

(57) ABSTRACT

The present invention concerns a method for cathodic corrosion protection of a substrate having a chromium surface and at least one intermediate layer between the substrate and the chromium surface, selected from the group comprising nickel, nickel alloys, copper and copper alloys and wherein said chromium surface is contacted with an aqueous solution comprising at least one compound containing phosphorous while passing an electrical current through said substrate, at least one anode and the aqueous solution wherein said substrate serves as the cathode.

13 Claims, No Drawings

METHOD FOR CATHODIC CORROSION PROTECTION OF CHROMIUM SURFACES

The present application is a U.S. National Stage Application based on and claiming benefit and priority under 35 U.S.C. §371 of International Application No. PCT/EP2014/062660, filed 17 Jun. 2014, which in turn claims benefit of and priority to European Application No. 13177307.9 filed 19 Jul. 2013, the entirety of both of which is hereby incorporated herein by reference.

FIELD OF THE INVENTION

The present invention relates to a wet-chemical method for cathodic corrosion protection of chromium surfaces, particularly of electroplated chromium surfaces.

BACKGROUND OF THE INVENTION

Chromium surfaces are used in various applications such as a decorative metal finish for plastic parts in automotive and sanitary industries or as wear resistant coatings for plated parts such as shock absorbers. The chromium surface is usually the outer surface of the substrate and obtained by electroplating a chromium layer from plating bath compositions comprising either Cr(III) ions, Cr(VI) ions or both.

The resulting chromium surface is usually very shiny and fulfils aesthetic requirements. The corrosion protection provided by the chromium layer to the underlying substrate is usually increased. However, in some applications of chromium surfaces such as in the automotive industry, the corrosion protection provided by the chromium layer is not sufficient, e.g. in case when 480 h ISO 9227 NSS-test without change of appearance of the chromium surface is required. This requirement can at the moment only be fulfilled by application of post-treatment methods with solutions comprising toxic Cr(VI) ions.

At least one other metal or metal alloy layer is located between said chromium layer and the substrate. The at least one metal or metal alloy layer is selected from one or more of nickel layer, nickel alloy layer, copper layer and copper alloy layer.

The chromium layer usually comprises micro-cracks after plating or (thermal) annealing, or pores created by an underlying micro-porous nickel layer. Hence, also the layer material(s) between the chromium layer and the substrate are exposed to the environment. Accordingly, the undesired corrosion of substrates having a chromium layer as the outer surface is caused by the corrosion of the underlying layers. The chromium oxide layer formed on the outer surface of the chromium layer protects said outer surface of the chromium layer from corrosion but not the underlying layer(s). Such multilayer assemblies comprising a chromium layer as the outermost layer are for example disclosed in US 2012/0052319 A1.

Different methods to increase the resistance to corrosion of chromium surfaces and the underlying metal and/or metal alloy layer(s) are known in the art.

Coating agents comprising polymers which contain 0.05 to 3 wt.-% sulfonate and/or phosphonate groups or their respective esters applied for cathodic electrocoating of electrically conductive substrates are disclosed in U.S. Pat. No. 4,724,244. Said polymer is deposited onto the electrically conductive substrate and thereby forms a corrosion protection layer having a thickness of several μm such as 18 μm. The resistance of corrosion is increased by said treatment but the optical appearance of a chromium surface and the surface feel is drastically changed by the thick polymer layer which is not acceptable for e.g. decorative applications of the chromium surface. Furthermore, this method requires a thermal curing of the as deposited polymer which is, due to the necessary high curing temperatures, not applicable to plastic substrates common in automotive industries.

An anodic treatment of metal surfaces with an aqueous solution comprising a compound having hydrophobic carbon-chains with hydrophilic anionic functional groups is disclosed in EP 2 186 928 A1. The resistance to corrosion can be increased by said method but residues creating a foggy appearance remain on the metal surface even after rinsing with water, especially on dark chromium surfaces. Hence, said method is not suitable to increase the resistance to corrosion of a chromium surface and maintain the optical properties of said chromium surface, i.e. the shiny and decorative optical appearance.

OBJECTIVE OF THE PRESENT INVENTION

It is the objective of the present invention to provide a wet-chemical method for corrosion protection of a substrate having a chromium surface which maintains the optical appearance of the chromium surface.

SUMMARY OF THE INVENTION

This objective is solved by a method for cathodic corrosion protection of a substrate having a chromium surface, the method comprising, in this order, the steps of (i) providing a substrate having a chromium surface and at least one intermediate layer between the substrate and the chromium surface, selected from the group consisting of nickel, nickel alloys, copper and copper alloys, (ii) contacting said substrate with an aqueous solution comprising at least one compound containing phosphorous according to formulae I. to VI.

I

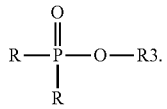

II

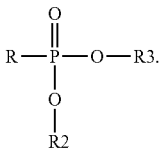

III

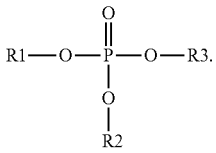

-continued

IV

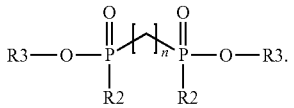

V

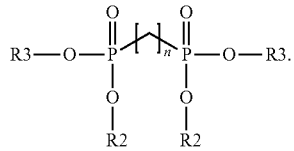

VI

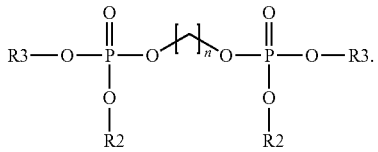

wherein R is selected from the group consisting of H, unsubstituted $C_1$-$C_{20}$-alkyl, linear or branched, unsubstituted $C_1$-$C_6$-alkaryl, linear or branched, and unsubstituted aryl, R1, R2 and R3 can be equal or different and are independently selected from the group consisting of H, $NH_4^+$, $Li^+$, $Na^+$, $K^+$, unsubstituted $C_1$-$C_{20}$-alkyl, linear or branched, unsubstituted $C_1$-$C_6$-alkaryl, linear or branched, and unsubstituted aryl, and wherein n is an integer ranging from 1 to 15 while passing an electrical current through said substrate, at least one anode and the aqueous solution wherein said substrate serves as the cathode and thereby forming a corrosion protection layer on the chromium surface.

The increased resistance of corrosion is obvious from a neutral salt spray test according to ISO 9227 NSS. Furthermore, the desired shiny appearance and colour of the chromium surface are maintained.

DETAILED DESCRIPTION OF THE INVENTION

Chromium surfaces to which the method for corrosion protection according to the present invention can be applied comprise chromium layers deposited by chemical and/or physical vapour deposition methods or by wet-chemical deposition methods such as electroplating from plating bath compositions comprising Cr(III) ions, Cr(VI) ions or both.

Preferably, the method for corrosion protection according to the present invention is applied to chromium surfaces obtained by electroplating.

At least one intermediate layer(s) selected from the group consisting of nickel, nickel alloys, copper and copper alloys is located between the substrate and the chromium layer whose surface is exposed. The at least one intermediate layer is required to obtain a smooth and shiny chromium surface because the chromium layer itself is very thin and cannot level the roughness imposed by the surface of the substrate.

The chromium layer usually comprises micro-cracks which can be created during electroplating or after (thermal) annealing. Another type of chromium layers having a microporosity is formed by electroplating the chromium layer on top of a nickel or nickel alloy—composite layer which comprises small particles of a non-conductive substance such as silica and/or alumina.

In all those cases, the chromium layer is not hermetically sealing the underlying intermediate metal and/or metal alloy layer(s). Accordingly, at least the most outer intermediate layer which is in direct contact with the chromium layer is also exposed the environment and corrosive media.

The method for cathodic corrosion protection utilizes an aqueous solution comprising at least one compound containing phosphorous.

The at least one compound containing phosphorous is selected from compounds according to formulae I. to VI.:

I

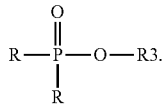

II

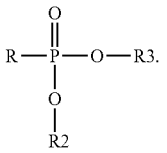

III

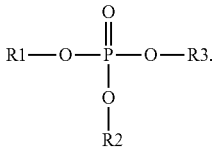

IV

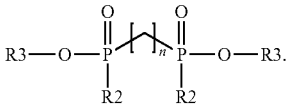

V

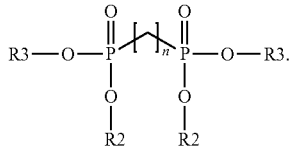

VI

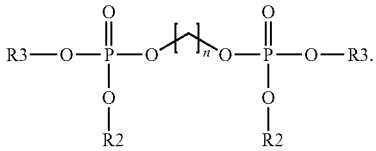

wherein R is selected from the group consisting of H, unsubstituted $C_1$-$C_{20}$-alkyl, linear or branched, unsubstituted $C_1$-$C_6$-alkaryl, linear or branched, and unsubstituted aryl, R1, R2 and R3 can be equal or different and are independently selected from the group consisting of H, $NH_4^+$, $Li^+$, $Na^+$, $K^+$, unsubstituted $C_1$-$C_{20}$-alkyl, linear or branched, unsubstituted $C_1$-$C_6$-alkaryl, linear or branched, and unsubstituted aryl, and wherein n is an integer ranging from 1 to 15.

In another embodiment of the present invention, R of the at least one compound containing phosphorous represented by formulae I. to III. is selected from the group consisting of n-octyl, n-nonyl, n-decyl, n-undecyl, n-dodecyl, n-tridecyl, n-tetradecyl, n-pentadecyl, n-hexadexyl, n-heptadecyl, n-octadecyl, unsubstituted branched $C_3$ to $C_{20}$ alkyl residues, and R2 and R3 are H or a suitable counter ion selected from $Li^+$, $Na^+$, $K^+$ and $NH_4^+$.

More preferably, the at least one compound containing phosphorous is selected from compounds according to formulae II. and V. wherein R is selected from the group consisting of n-octyl, n-nonyl, n-decyl, n-undecyl, n-dodecyl, n-tridecyl, n-tetradecyl, n-pentadecyl, n-hexadexyl, n-heptadecyl, n-octadecyl, unsubstituted branched $C_8$ to $C_{18}$ alkyl residues, and wherein R2 and R3 are H or a suitable counter ion selected from $Li^+$, $Na^+$, $K^+$ and $NH_4^+$.

The most preferred at least one compound containing phosphorous is selected from compounds according to formula II. wherein R is selected from the group consisting of n-octyl, n-nonyl, n-decyl, n-undecyl, n-dodecyl, n-tridecyl, n-tetradecyl, n-pentadecyl, n-hexadexyl, n-heptadecyl, n-octadecyl, unsubstituted branched $C_8$ to $C_{18}$ alkyl residues, and wherein R2 and R3 are H or a suitable counter ion selected from $Li^+$, $Na^+$, $K^+$ and $NH_4^+$.

The concentration of the at least one compound containing phosphorous according to formulae I. to VI. in the aqueous solution preferably ranges from 0.0001 to 0.5 mol/l, more preferably from 0.0005 to 0.05 mol/l and most preferably from 0.001 to 0.025 mol/l.

The aqueous solution optionally further comprises at least one additive which increases the solubility of the at least one compound containing phosphorous. This additive is preferably a compound comprising a polyether group such as alkoxylated bisphenols and ethyleneoxide-propyleneoxide block-copolymers.

Suitable compounds containing a polyether group and the concentration range of such an additive can be determined by routine experiments: the compound containing phosphorous and said additive are mixed in water and the cloudiness of the resulting mixture is determined by visual inspection. A clear or only slightly cloudy mixture is suitable for the method according to the present invention. A cloudy mixture is not desired.

More preferably, the at least one additive which increases the solubility of the at least one compound containing phosphorous is selected from compounds represented by formula VII.

VII

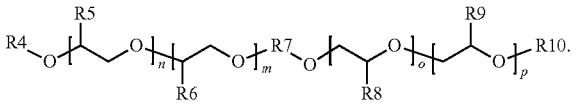

wherein m, n, o and p are integers ranging from 0 to 200 and are the same or different and m+n+o+p is at least 2. Preferably m+n+o+p ranges from 4 to 100, more preferably from 10 to 50 and wherein R4 and R10 are the same or different and are selected independently from the group consisting of H, a suitable counter ion like $Li^+$, $Na^+$, $K^+$ and $NH_4^+$, $C_1$-$C_{20}$-alkyl, substituted or unsubstituted, linear or branched, $C_1$-$C_6$-alkaryl, linear or branched, allyl, aryl, sulfate, phosphate, halide and sulfonate and wherein each of the R5, R6, R8 and R9 groups may be the same or different and are selected independently from the group consisting of H, $C_1$-$C_6$-alkyl, linear or branched, substituted or unsubstituted and wherein R7 is selected from the group consisting of $C_1$-$C_{12}$-alkylene, linear or branched, substituted or unsubstituted, arylene 1,2-, 1,3- and 1,4-substituted, naphthylene, 1,3-, 1,4- 1,5- 1,6- and 1,8-substituted, higher annulated arylene, cylcloalkylene, —O—$(CH_2(CH_2)_n$OR4, wherein R7 has the meaning defined above, and moieties represented by formula VIII.

VIII

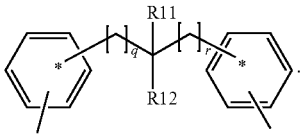

wherein the substitution independently is 1,2-, 1,3- or 1,4 for each ring and wherein q and r are the same or different and range independently from 0 to 10 and R11 and R12 are selected independently from the group consisting of H and $C_1$-$C_6$-alkyl, linear or branched.

Substituted alkyl, alkaryl and aryl groups described herein are hydrocarbyl moieties which are substituted with at least one atom other than carbon and hydrogen, including moieties in which a carbon chain atom is substituted with a hetero atom such as nitrogen, oxygen, silicon, phosphorous, boron, sulfur, or a halogen atom. The hydrocarbyl moieties may be substituted with one or more of the following substituents: halogen, heterocyclo, alkoxy, alkenoxy, alkynoxy, aryloxy, hydroxy, protected hydroxy, hydroxycarbonyl, keto, acyl, acyloxy, nitro, amino, amido, nitro, phosphono, cyano, thiol, ketals, acetals, esters and ethers.

Preferred are additives wherein R4 and R10 of the additive according to formula VII. are selected independently from the group consisting of H, methyl, sodium, potassium, halide, sulfate, phosphate and sulfonate.

Preferred are additives wherein R5, R6, R8 and R9 of the additive according to formula VII. are selected independently from the group consisting of H, methyl, ethyl, n-propyl and isopropyl.

Preferred are additives wherein R7 of the additive according to formula VII. is selected from the group represented by formulae IX. and X.

IX

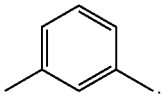

and

X

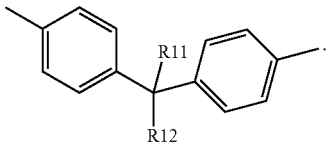

and wherein R11 and R12 are selected from the group consisting of H, methyl, ethyl, n-propyl and isopropyl.

Additives increasing the solubility of the at least one compound containing phosphorous having the following formulae are particularly preferred.

XI

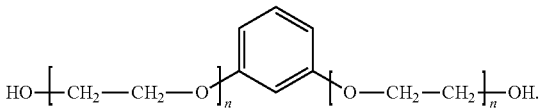

and wherein n ranges from 1 to 20, preferably from 3 to 8.

XII

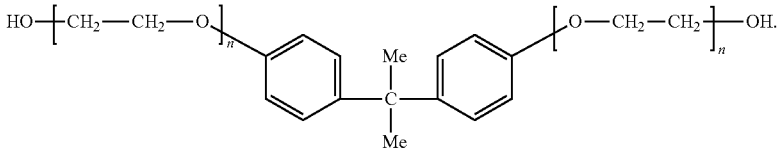

and wherein n ranges from 1 to 20, preferably from 2 to 10.

XIII

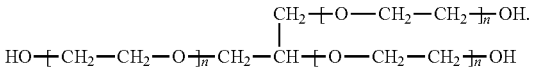

wherein n ranges from 1 to 20, preferably from 2 to 7.

The concentration of the at least one optional additive which increases the solubility of the at least one compound containing phosphorous preferably ranges from 0.0001 to 0.1 mol/l, more preferably from 0.0005 to 0.05 mol/l and most preferably from 0.001 to 0.005 mol/l.

The aqueous solution comprising at least one compound containing phosphorous optionally further comprises a co-solvent which may improves the solubility of the at least one compound containing phosphorous in the main solvent water. The optional co-solvent is preferably a polar organic solvent selected from the group consisting of alcohols such as ethanol, iso-propanol, butanol; alkyl ethers of glycols such as 1-methoxy-2-propanol, monoalkyl ethers of ethylene glycol, diethylene glycol, propylene glycol, butyl glycol, ketones such as methyl ethyl ketone, methyl isobutyl ketone, isophorone; esters and ethers such as 2-ethoxyethyl acetate and 2-ethoxyethanol.

The concentration of the optional co-solvent calculated from the total amount of all solvents present (water and co-solvent(s)) preferably ranges from 0.0001 to 40 wt.-%, more preferably from 0.01 to 20 wt.-% and most preferably from 0.1 to 10 wt.-%.

In one embodiment of the present invention, the aqueous solution comprises at least one compound containing phosphorous, at least one additive which increases the solubility of the at least one compound containing phosphorous and at least one co-solvent.

The aqueous solution may further comprises anti-foam additives which are known in the art, and a conducting salt such as sodium and/or ammonium acetate, or sodium and/or ammonium phosphates and anionic surfactants such as sodium dodecyl sulfate.

The pH value of the aqueous solution comprising at least one compound containing phosphorous preferably ranges from 1 to 8, more preferably from 1.5 to 6.5 and most preferably from 3 to 6.

The substrate comprising a chromium surface is brought into contact with the aqueous solution by dipping said substrate into said aqueous solution, by spraying said aqueous solution onto said substrate or by brushing said aqueous solution onto said substrate.

Furthermore, an electric current is passed through the substrate comprising a chromium surface and the aqueous solution comprising at least one compound containing phosphorous. The substrate comprising a chromium surface serves as the cathode in the method for corrosion protection according to the present invention. Only then the required corrosion protection is achieved while the desired optical properties of the chromium surface such as shininess and colour are maintained.

The current density applied the substrate comprising a chromium surface (the cathode) preferably ranges from 0.005 to 5 A/dm$^2$, more preferably from 0.01 to 2 A/dm$^2$ and most preferably from 0.02 to 1 A/dm$^2$.

No sufficiently increased resistance to corrosion is obtained when no current is applied between the substrate comprising a chromium surface (Example 3). Undesired foggy deposits and/or an undesired dark haze are formed on the chromium surface in case the applied current density is too high (Example 2) or if the substrate comprising a chromium surface is utilized as an anode (Example 4).

The anode can be for example made of a material selected from the group comprising stainless steel, platinum or platinized titanium.

The current is applied to the substrate comprising a chromium surface for 10 to 900 s, more preferably from 15 to 600 s and most preferably from 30 to 300 s.

The temperature of the aqueous solution comprising at least one compound containing phosphorous is preferably held at a temperature in the range of 20 to 80° C., more preferably of 30 to 70° C. and most preferably of 40 to 60° C. when contacting the substrate comprising a chromium surface with said aqueous solution.

EXAMPLES

The invention will now be illustrated by reference to the following non-limiting examples.

ABS substrates of the same size which comprise a multilayer coating of copper, semi-bright nickel, bright nickel, non-conductive particle containing nickel ("microporous nickel") and a top coat consisting of a chromium layer were used throughout all examples. The chromium layer was either a bright chromium layer or a dark chromium layer as indicated in the respective examples which has been deposited from a trivalent chromium based electrolyte.

The optical appearance of the chromium surface was visually inspected prior to the neutral salt spray tests.

Neutral salt spray tests were performed according to ISO 9227 NSS. The results are given with the respective examples.

The substrates were rinsed with water and dried after the neutral salt spray tests and then visually inspected. No visible change of the appearance after a given time in the salt spray test chamber was considered desirable and a change of the optical appearance on more than 5% of the chromium surface (determined with a caliber plate) were considered as failed the corrosion test.

Example 1 (Comparative)

A bright chromium surface was investigated without any post-treatment by a neutral salt spray test according to ISO 9227 NSS.

The untreated chromium surface failed the corrosion test when visually inspected after 480 h neutral salt spray test due to significant change of appearance on more than 5% of the chromium surface.

Example 2 (Comparative)

A bright chromium surface was treated with an aqueous solution comprising 0.93 g/l (3.7 mmol/l) n-dodecylphosphonic acid, 7.5 g/l of an additive according to formula XII. and 6 wt.-% ethanol for 60 s at 40° C. without applying an external current to said chromium surface.

The treated chromium surface failed the corrosion test when visually inspected after 480 h neutral salt spray test, because more than 5% of the chromium surface showed a visible change of the appearance.

Example 3 (Comparative)

A bright chromium surface was treated with an aqueous solution comprising 0.93 g/l (3.7 mmol/l) n-dodecylphosphonic acid, 7.5 g/l of an additive according to formula XII. and 6 wt.-% ethanol for 30 s at 40° C. while applying a current density of 0.05 A/dm$^2$ to the chromium surface as the anode. This comparative example is in accordance with the teaching in EP 2 186 928 A1.

The chromium surface comprised undesired foggy deposits on its surface after the post-treatment. Rinsing with water did not remove the undesired foggy deposits from the chromium surface. Hence, this treatment is not acceptable for an industrial use.

Example 4

A bright chromium surface was treated with an aqueous solution comprising 0.93 g/l (3.7 mmol/l) n-dodecylphosphonic acid, 7.5 g/l of an additive according to formula XII. and 6 wt.-% ethanol for 30 s at 40° C. while applying a current density of 0.05 A/dm$^2$ to the chromium surface as the cathode.

The optical appearance of the chromium surface was not changed after the post-treatment.

The treated chromium surface passed the corrosion test when visually inspected after 480 h neutral salt spray test.

Example 5 (Comparative)

A dark chromium surface was investigated without any post-treatment by a neutral salt spray test according to ISO 9227 NSS.

The untreated chromium surface failed the corrosion test when visually inspected after 480 h neutral salt spray test.

Example 6 (Comparative)

A dark chromium surface was treated with an aqueous solution comprising 0.93 g/l (3.7 mmol/l) n-dodecylphosphonic acid, 7.5 g/l of an additive according to formula XII. and 6 wt.-% ethanol for 60 s at 40° C. without applying an external current to said chromium surface.

The untreated chromium surface failed the corrosion test when visually inspected after 480 h neutral salt spray test because more than 5% of the chromium surface showed a visible change of the appearance.

Example 7 (Comparative)

A dark chromium surface was treated with an aqueous solution comprising 0.93 g/l (3.7 mmol/l) n-dodecylphosphonic acid, 7.5 g/l of an additive according to formula XII. and 6 wt.-% ethanol for 30 s at 40° C. while applying a current density of 0.05 A/dm$^2$ to the chromium surface as the anode. This comparative example is in accordance with the teaching in EP 2 186 928 A1.

The chromium surface comprised an undesired iridescent layer on its surface after the post-treatment. Rinsing with water did not remove the undesired iridescent layer from the chromium surface. Hence, this treatment is not acceptable for an industrial use.

Example 8

A dark chromium surface was treated with an aqueous solution comprising 0.93 g/l (3.7 mmol/l) n-dodecylphosphonic acid, 7.5 g/l of an additive according to formula XII. and 6 wt.-% ethanol for 30 s at 40° C. while applying a current density of 0.05 A/dm$^2$ to the chromium surface as the cathode.

The optical appearance of the chromium surface was not changed after the post-treatment.

The treated chromium surface passed the corrosion test when visually inspected after 480 h neutral salt spray test.

Example 9 (Comparative)

A dark chromium surface was treated with an aqueous solution comprising 0.75 g/l (4.0 mmol/l) n-octylphosphonic acid, 7.5 g/l of an additive according to formula XII., 0.6 wt.-% isopropylglycol and 9.3 g/l ammonium acetate for 60 s at 50° C. without applying an external current to said chromium surface.

The treated chromium surface failed the corrosion test when visually inspected after 240 h neutral salt spray test, because more than 5% of the chromium surface showed a visible change of the appearance.

Example 10 (Comparative)

A dark chromium surface was treated with an aqueous solution comprising 0.75 g/l (4.0 mmol/l) n-octylphosphonic acid, 7.5 g/l of an additive according to formula XII., 0.6 wt.-% isopropylglycol and 9.3 g/l ammonium acetate for 30 s at 50° C. while applying a current density of 0.05 A/dm$^2$ to the chromium surface as the anode. This comparative example is in accordance with the teaching in EP 2 186 928 A1.

The chromium surface comprised an undesired iridescent layer on its surface after the post-treatment. Rinsing with water did not remove the undesired iridescent layer from the chromium surface. Hence, this treatment is not acceptable for an industrial use.

Example 11

A dark chromium surface was treated with an aqueous solution comprising 0.75 g/l (4.0 mmol/l) n-octylphosphonic acid, 7.5 g/l of an additive according to formula XII., 0.6 wt.-% isopropylglycol and 9.3 g/l ammonium acetate for 30 s at 50° C. while applying a current density of 0.05 A/dm$^2$ to the chromium surface as the cathode.

The optical appearance of the chromium surface was not changed after the post-treatment.

The treated chromium surface passed the corrosion test when visually inspected after 240 h neutral salt spray test.

Example 12

A dark chromium surface was treated with an aqueous solution comprising 0.93 g/l (5.9 mmol/l) phenylphosphonic acid, 7.5 g/l of an additive according to formula XII. and 9.3 g/l ammonium acetate for 60 s at 50° C. while applying a current density of 0.05 A/dm$^2$ to the chromium surface as the cathode.

The optical appearance of the chromium surface was not changed after the post-treatment.

The treated chromium surface passed compared to an untreated dark chromium surface the corrosion test when visually inspected after the same time under neutral salt spray test conditions.

Example 13

A dark chromium surface was treated with an aqueous solution comprising 0.93 g/l (3.1 mmol/l) 1,10-decyldiphosphonic acid, 7.5 g/l of an additive according to formula XII. and 9.3 g/l ammonium acetate for 60 s at 50° C. while applying a current density of 0.05 A/dm$^2$ to the chromium surface as the cathode.

The optical appearance of the chromium surface was not changed after the post-treatment.

The treated chromium surface passed compared to an untreated dark chromium surface the corrosion test when visually inspected after the same time under neutral salt spray test conditions.

Example 14 (Comparative)

0.75 g/l (4.0 mmol/l) n-octylphosphonic acid were added to water at ambient temperature without further additives. The resulting mixture is cloudy at ambient temperature and still cloudy when increasing the temperature to 50° C. Accordingly, this mixture is considered as not suitable for use in the method according to the present invention.

Example 15

0.75 g/l (4.0 mmol/l) n-octylphosphonic acid were added together with an ethyleneoxide-propyleneoxide block-copolymer according to formula VII. to water at ambient temperature. The resulting mixture is clear and homogeneous at ambient temperature and when increasing the temperature to 50° C. Accordingly, this mixture is considered as suitable for use in the method according to the present invention.

Example 16

0.75 g/l (4.0 mmol/l) n-octylphosphonic acid were added together with an ethoxylated bisphenol according to formula XII. to water at ambient temperature. The resulting mixture is slightly cloudy and homogeneous at ambient temperature and when increasing the temperature to 50° C. Accordingly, this mixture is considered suitable for use in the method according to the present invention.

The invention claimed is:

1. A method for cathodic corrosion protection of a chromium surface, the method comprising in this order the steps of (i) providing a substrate having a chromium surface and at least one intermediate layer between the substrate and the chromium surface selected from the group consisting of nickel, nickel alloys, copper and copper alloys, (ii) contacting said substrate with an aqueous solution comprising at least one compound containing phosphorous according to formulae II. and V.:

II

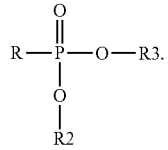

V

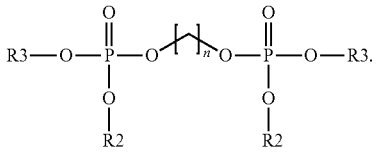

wherein R is selected from the group consisting of H, unsubstituted $C_1$-$C_{20}$-alkyl, linear or branched, unsubstituted $C_1$-$C_6$-alkaryl, linear or branched, and unsubstituted aryl, R2 and R3 can be equal or different and are independently selected from the group consisting of H, $NH_4^+$, $Li^+$, $Na^+$, $K^+$, unsubstituted $C_1$-$C_{20}$-alkyl, linear or branched, unsubstituted $C_1$-$C_6$-alkaryl, linear or branched, and unsubstituted aryl, and wherein n is an integer ranging from 1 to 15, and at least one additive which increases the solubility of the at least one compound containing phosphorus, wherein the at least one additive which increases the solubility of the at least one compound containing phosphorous is a polyether compound;

while passing an electrical current through said substrate, at least one anode and the aqueous solution wherein said substrate serves as cathode and thereby forming a corrosion protection layer on the chromium surface.

2. The method for cathodic corrosion protection according to claim 1 wherein the at least one compound containing phosphorous is selected from compounds according to formulae II. and V. wherein R is selected from the group consisting of n-octyl, n-nonyl, n-decyl, n-undecyl, n-dodecyl, n-tridecyl, n-tetradecyl, n-pentadecyl, n-hexadecyl, n-heptadecyl, n-octadecyl, unsubstituted branched $C_8$ to $C_{18}$ alkyl residues, and wherein R2 and R3 are H or a suitable counter ion independently selected from $Li^+$, $Na^+$, $K^+$ and $NH_4^+$.

3. The method for cathodic corrosion protection according to claim 1 wherein the at least one compound containing phosphorous is selected from compounds according to formula II. wherein R of the compound containing phosphorous is selected from the group consisting of n-octyl, n-nonyl, n-decyl, n-undecyl, n-dodecyl, n-tridecyl, n-tetradecyl, n-pentadecyl, n-hexadecyl, n-heptadecyl, n-octadecyl, and wherein R2 and R3 are H or a suitable counter ion independently selected from $Li^+$, $Na^+$, $K^+$ and $NH_4^+$.

4. The method for cathodic corrosion protection according to claim 1 wherein the concentration of the at least one compound containing phosphorous in the aqueous solution ranges from 0.0001 to 0.5 mol/l.

5. The method for cathodic corrosion protection according to claim 1 wherein the electrical current passed through the substrate ranges from 0.005 to 5 A/dm$^2$.

6. The method for cathodic corrosion protection according to claim 1 wherein the aqueous solution is held during step (ii) at a temperature in the range of 20 to 80° C.

7. The method for cathodic corrosion protection according to claim 1 wherein the substrate is contacted in step (ii) with the aqueous solution for 10 to 900 s.

8. The method for cathodic corrosion protection according to claim 1 wherein the at least one anode is made from a material selected from the group consisting of stainless steel, platinum or platinized titanium.

9. The method for cathodic corrosion protection according to claim 1 wherein the at least one additive which increases the solubility of the at least one compound containing phosphorous is selected from compounds represented by formula VII.

VII

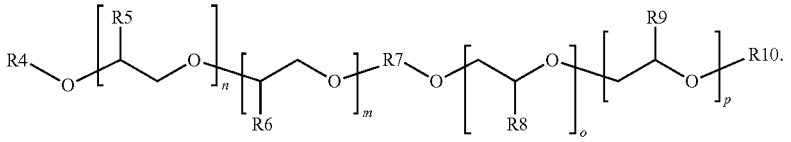

wherein m, n, o and p are integers ranging from 0 to 200 and are the same or different and m+n+o+p is at least 2, and wherein R4 and R10 are the same or different and are selected independently from the group consisting of H, a suitable counter ion like $Li^+$, $Na^+$, $K^+$ and $NH_4^+$, $C_1$-$C_{20}$-alkyl, substituted or unsubstituted, linear or branched, $C_1$-$C_6$-alkaryl, linear or branched, allyl, aryl, sulfate, phosphate, halide and sulfonate and wherein each of the R5, R6, R8 and R9 groups may be the same or different and are selected independently from the group consisting of H, $C_1$-$C_6$-alkyl, linear or branched, substituted or unsubstituted and wherein R7 is selected from the group consisting of $C_1$-$C_{12}$-alkylene, linear or branched, substituted or unsubstituted, arylene 1,2-, 1,3- and 1,4-substituted, naphthylene, 1,3-, 1,4- 1,5- 1,6- and 1,8-substituted, higher annulated arylene, cylcloalkylene, —O—$(CH_2(CH_2)_n$OR4, wherein R4 has the meaning defined above, and moieties represented by formula VIII.

VIII

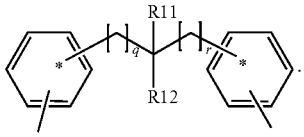

wherein in formula VIII, the substitution independently is 1,2-, 1,3- or 1,4 for each ring and wherein q and r are the same or different and range independently from 0 to 10 and R11 and R12 are selected independently from the group consisting of H and $C_1$-$C_6$-alkyl, linear or branched.

10. The method for cathodic corrosion protection according to claim 1 wherein the at least one additive which increases the solubility of the at least one compound containing phosphorous is one or more compound selected from compounds according to the following formulae XI., XII., and XIII.

XI

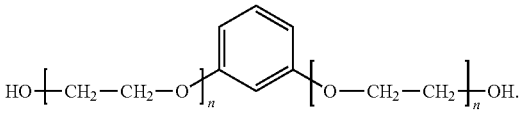

and wherein n ranges from 1 to 20,

XII

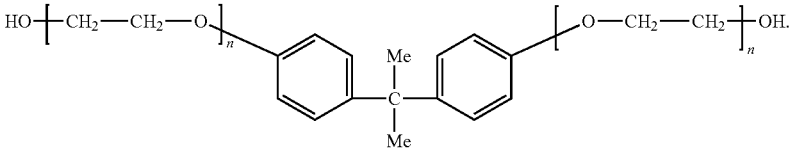

and wherein n ranges from 1 to 20,

XIII

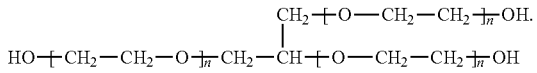

wherein n ranges from 1 to 20.

11. The method for cathodic corrosion protection according to claim 1 wherein the concentration of the at least one additive which increases the solubility of the at least one compound containing phosphorous ranges from 0.0001 to 0.1 mol/l.

12. The method for cathodic corrosion protection according to claim 1 wherein the aqueous solution further comprises a co-solvent selected from the group consisting of alcohols, alkyl ethers of glycols, ketones, esters and ethers.

13. The method for cathodic corrosion protection according to claim 12 wherein the concentration of the co-solvent ranges from 0.0001 to 40 wt.-%.

* * * * *